US005844539A

United States Patent [19]

Kitagawa

[11] Patent Number: 5,844,539

[45] Date of Patent: Dec. 1, 1998

[54] IMAGE DISPLAY SYSTEM

[75] Inventor: Hideyuki Kitagawa, Kanagawa, Japan

[73] Assignee: Sony Corporation, Tokyo, Japan

[21] Appl. No.: 789,380

[22] Filed: Jan. 28, 1997

[30] Foreign Application Priority Data

Feb. 2, 1996 [JP] Japan ..... 8-040609

[51] Int. Cl.[6] ..... G09G 3/38

[52] U.S. Cl. ..... 345/100; 345/132; 345/204

[58] Field of Search ..... 345/100, 98, 99, 345/132, 204; 348/490–492, 529–530, 540–548, 434–435

[56] References Cited

U.S. PATENT DOCUMENTS

| | | | |
|---|---|---|---|
| 5,394,486 | 2/1995 | Eisenbarth et al. | 348/434 |
| 5,416,598 | 5/1995 | Ezaki | 348/434 |
| 5,448,260 | 9/1995 | Zenda et al. | 345/100 |
| 5,523,795 | 6/1996 | Ueda | 348/434 |
| 5,583,574 | 12/1996 | Tanaka et al. | 348/434 |
| 5,657,034 | 8/1997 | Yamazaki | 345/132 |

*Primary Examiner*—Richard A. Hjerpe
*Assistant Examiner*—Ricardo Osorio
*Attorney, Agent, or Firm*—Jay H. Maioli

[57] ABSTRACT

An image display system has a main-driver, a sub-driver, a display panel, and a timing generator. The main-driver supplies plural types of video signals having different standards of resolution, while the sub-driver, independent from the main-driver, supplies a black signal whose brightness can be controlled. The display panel includes a vertical scanning circuit for sequentially selecting rows of pixels, a horizontal scanning circuit for distributing the video signals to columns of the pixels so as to be written into the selected pixels, and an auxiliary scanning circuit for distributing the black signal to columns of the pixels so as to be written into the selected pixels. The timing generator controls the respective scanning circuits in the display panel by distributing control signals in accordance with the resolution of the video signals. Thereby, the video signals are written into a display region in a screen including the pixels which has the numbers of rows and columns adapted for the resolution, and the black signal is written into the pixels belonging to a blank region outside the display region.

8 Claims, 6 Drawing Sheets

IMAGE DISPLAY SYSTEM

BACKGROUND OF THE INVENTION

1. Field of the Invention

The present invention relates to image display systems which use an active matrix liquid crystal display panel or the like as a display, and in particular to an image display system capable of appropriately displaying video signals which have different standards of resolution.

2. Description of the Related Art

By referring to FIG. 7, one example of a conventional active matrix display panel will be briefly described. This display panel includes a driving substrate 101, a counter substrate 102, and an electrochemical substance 103 provided therebetween. As the electrochemical substance 103, liquid crystal materials are widely used. In the driving substrate 101, a screen portion 104 and a peripheral circuit portion are formed. The peripheral circuit portion is separated into a vertical scanning circuit 105 and a horizontal scanning circuit 106. Also, terminal portions 107 for external connection are formed on the upper end of the driving substrate 101. The terminal portions 107 are connected to the vertical scanning circuit 105 and the horizontal scanning circuit 106 by wires 108. On an overall inner surface of the counter substrate 102, counter electrodes (not shown) are formed. In the screen portion 104, gate lines 109 along the row direction and signal lines 110 along the column direction are formed. The gate lines 109 are connected to the vertical scanning circuit 105, while the signal lines 110 are connected to the horizontal scanning circuit. Pixels comprised of pixel electrodes 111 and thin film transistors 112 for driving the pixel electrodes 111 are formed to be integrated where both lines intersect. The vertical scanning circuit 105, activated in synchronism with a vertical start signal or a vertical clock signal inputted from the exterior, sequentially selects rows of the pixels formed in the screen portion 104. The horizontal scanning circuit 106, activated in accordance with a control signal such as a horizontal start signal or a horizontal clock signal inputted from the exterior, sequentially distributes a video signal supplied from the exterior to columns of the pixels, and writes the video signal into the selected pixels.

Concerning the video signal supplied from the exterior, there are various standards of resolution. For example, concerning the video signal for television, there are the NTSC (National Television System Committee) standard and the PAL (phase alternation line) standard. If the screen portion of the display panel shown in FIG. 7 has a pixel arrangement in accordance with the NTSC standard, conventionally, the display panel converts a PAL video signal to scanning lines, in other words, performs so-called sampling driving with respect to pixel rows. Accordingly, a field memory for temporarily storing the video signal is used. In addition, these days, an active matrix display panel is widely used as a display for computer graphics. Also in this case a personal computer outputs video signals having various types of standards of resolution. However, the video signal outputted from the personal computer is in units of dots, thus, when conversion to scanning lines is performed with respect to the video signal in accordance with its standard of resolution similar to the case of the television video signal, so-called moire appears on the screen. In other words, a phase shift of the sampling timing of the video signal from a dot-unit data arrangement in the process of conversion to scanning lines causes a phase difference at a relatively large cycle between the data arrangement and a pixel arrangement on the screen, which phase difference appears as moire. The elimination of the moire requires large-scale signal processing, thus increasing the cost. Consequently, to suppress the moire, it is required that the resolution of the video signal supplied from the personal computer or the like must correspond to the pixel arrangement formed on the screen in the display panel. In this case, when a display panel, designed for a relatively high resolution video signal, displays a relatively low resolution video signal, pixels into which the video signal has not been written inevitably remain on the periphery of the screen, and become a blank region. Conventionally, to improve the display quality on the screen, black is displayed on the blank region outside the display region. As a driving method for displaying black, a method in which the pedestal level of a video signal is written within a vertical blanking period is employed. The pedestal level exceeds the standard of a black level. However, according to this conventional method, a problem occurs, that is, brightness control by a user causes a change in the brightness of black displayed in the blank region, thus, the outside of the display region can hardly display uniform black.

SUMMARY OF THE INVENTION

Accordingly, it is an object of the present invention to provide an image display system capable of displaying video signals having different resolutions on the same display panel.

According to an aspect of the present invention, the foregoing object is achieved by the provision of an image display system including: a driver for supplying a plurality of types of video signals having different standards of resolution, and for supplying a black signal independent from the video signals, the brightness of which is capable of being controlled; a display panel having a screen comprised of a plurality of pixels arranged in a matrix, a vertical scanning circuit for sequentially selecting rows of the pixels, and a horizontal scanning circuit for sequentially distributing the video signals and the black signal to columns of the pixels so as to be written into pixels selected from the pixels; and a timing generator for controlling the timing of the distribution of a control signal in accordance with the resolution of the video signals supplied from the driver to each scanning circuit in the display panel, the timing generator writing the video signals in a display region within the screen including rows and columns of the pixels adapted for the resolution, and the timing generator including means for controlling the black signal to be written into the pixels belonging to a blank region of the screen outside the display region.

The horizontal scanning circuit may include a first horizontal scanning circuit for sequentially distributing the video signals to columns of the pixels so as to be written into the selected pixels, and a second scanning circuit for distributing the black signal so as to be written into the selected pixels.

The timing generator may control the vertical scanning circuit in the display panel to operate so that the black signal is written into each row of the pixels included in the upper and lower portions of the blank region within a vertical blanking period for the video signals. In the blank region the black signal may be written by an inversion-to-line method.

The timing generator may control a portion of the vertical scanning circuit in the display panel to operate simultaneously so that the black signal and the video signals are written into collective rows of the pixels included in the upper and lower portions of the blank region during a vertical blanking period for the video signals. The black signal may be written by an inversion-to-field method with respect to the upper rows and the lower rows in the blank region.

According to another aspect of the present invention, the foregoing object is achieved by the provision of a method for driving an image display system including: a driver for supplying a plurality of types of video signals having different standards of resolution, and for supplying a black signal independent from the video signals, the brightness of which is capable of being controlled; a screen comprised of a plurality of pixels arranged in a matrix; a display panel having a screen comprised of a plurality of pixels arranged in a matrix, a vertical scanning circuit for sequentially selecting rows of the pixels, and a horizontal scanning circuit for sequentially distributing the video signals and the black signal to columns of the pixels so as to be written into selected pixels selected from the pixels; and a timing generator for controlling the timing of the distribution of a control signal in accordance with the resolution of the video signals supplied from the driver to each scanning circuit in the display panel, the method comprising the steps of: writing the video signals into a display region within the screen including rows and columns of the pixels adapted for the resolution; and writing the black signal into the pixels belonging to a blank region of the screen outside the display region.

The black signal and the video signals may be written into each row of the pixels included in the upper and lower portions of the blank region during a vertical blanking period for the video signals.

The black signal and the video signals may be simultaneously written into rows of the pixels included in the upper and lower portions of the blank region during a vertical blanking period for the video signals.

As described above, according to the present invention, when the video signals having different resolutions are displayed on the same display panel, the image display system includes the generating circuit for the black signal, which is independent from the video signals, as a means for displaying black on the blank region outside the display region. By inputting the black signal into the display panel via another path, black can be firmly displayed on the blank region without being affected by the user brightness control.

DESCRIPTION OF THE PREFERRED EMBODIMENT

Referring to the attached drawings, one of the optimum embodiments of the present invention will be described.

Figure 1:
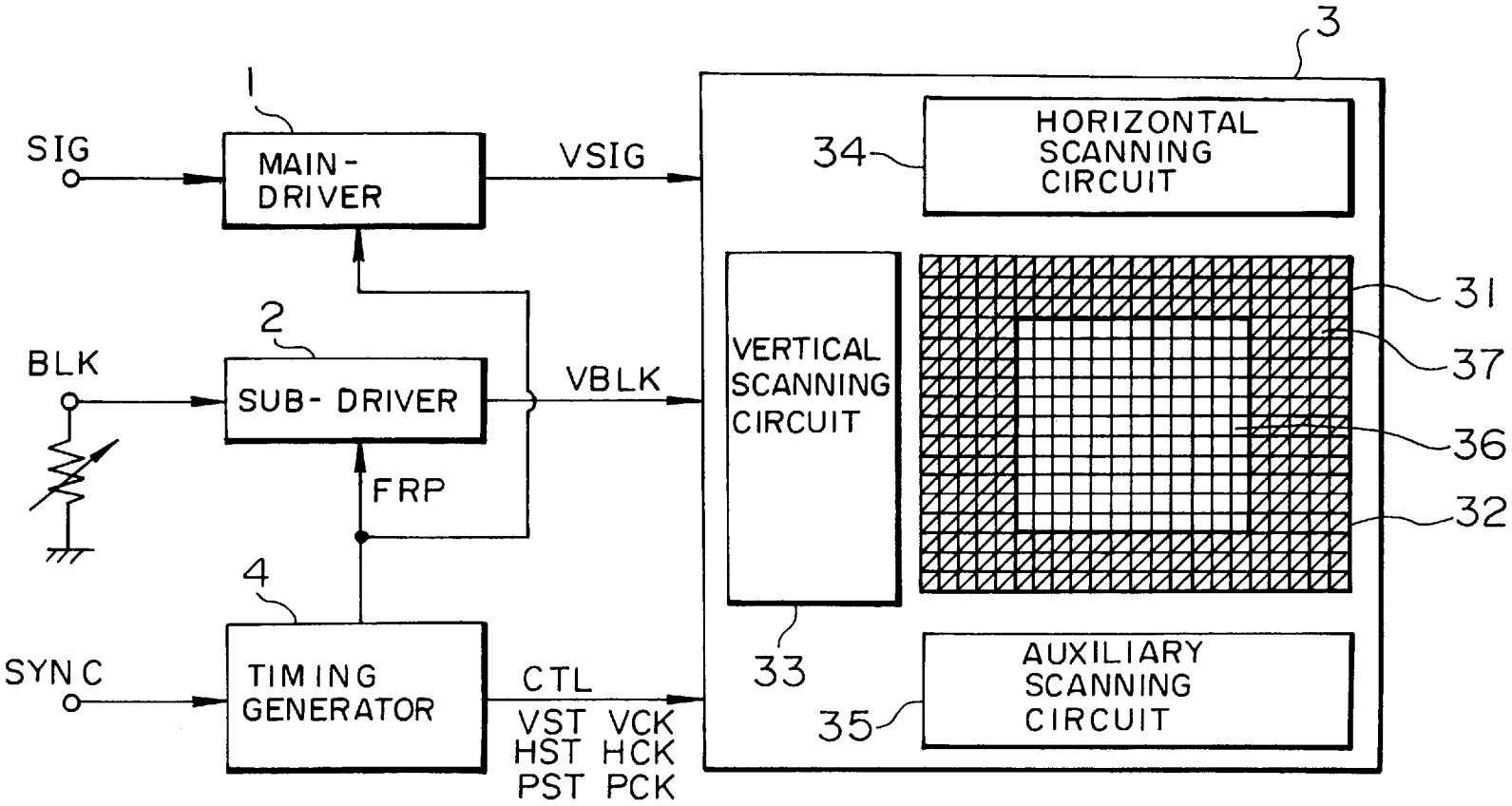
FIG. 1 is a block diagram showing a basic configuration of an image display system according to the present invention.

FIG. 1 shows a block diagram of the whole of an image display system according to the present invention. This image display system includes a main-driver 1, a sub-driver 2, a display panel 3, and a timing generator 4. The main-driver 1 supplies plural types of video signals VSIG having different standards of resolution to the display panel 3. The main-driver 1 converts an original video signal SIG outputted from an apparatus such as a personal computer into an AC signal in accordance with an AC-converting signal FRP supplied from the timing generator 4, and outputs the video signals VSIG which are separated corresponding to red, green and blue. Also, the sub-driver 2 (black signal generating circuit) supplies a black signal whose brightness can be controlled independently from the video signals VSIG to the display panel 3. In other words, the sub-driver 2, being supplied with a black level voltage BLK whose level can be controlled, converts it into an AC voltage in accordance with the AC-converting signal FRP supplied from the timing generator 4, and outputs a final black signal VBLK to the display panel 3. Practically, the main-driver 1 and the sub-driver 2 are incorporated to form a one-chip IC, which is called the driver.

The display panel 3 includes a screen 31 in which a large number of pixels 32 are arranged in a matrix. The display panel 3 is a type having a built-in peripheral circuit, and has a vertical scanning circuit 33, a horizontal scanning circuit 34 and an auxiliary scanning circuit 35, which are formed around the screen 31 to be integrated on the same substrate. The vertical scanning circuit 33 sequentially selects rows of the pixels 32 formed in the screen 31. The horizontal scanning circuit 34 sequentially distributes the video signals VSIG supplied from the main-driver 1 to rows of the pixels 32, and writes the distributed signals into the selected pixels 32. The auxiliary scanning circuit 35 distributes the black signal VBLK supplied from the sub-driver 2 to rows of the pixels and writes the supplied black signal VBLK into the selected pixels 32.

Based on a synchronizing signal SYNC supplied from the personal computer 1, the timing generator 4 controls the operations of the vertical scanning circuit 33, the horizontal scanning circuit 34 and the auxiliary scanning circuit 35 in the display panel 3 by outputting various types of control signals to the scanning circuits in accordance with the resolution of the video signals VSIG supplied to the display panel 3. The control signals include a vertical start signal VST and a vertical clock signal VCK which are supplied to the vertical scanning circuit 33, a horizontal start signal HST and a horizontal clock signal HCK which are supplied to the horizontal scanning circuit 34, a start signal PST and a clock signal PCK which are supplied to the auxiliary scanning circuit 35, and a control signal CTL used to switch over between the respective scanning circuits 33, 34 and 35. In this arrangement the video signals VSIG are written into the display region in the screen 31 including the pixels 32 which has the numbers of rows and columns adapted for the resolution of the video signals VSIG, and the black signal VBLK is written into the pixels 32 which belongs to the blank region 37 outside the display region 36.

Further, in general, a monitor for display is provided with a user brightness function to control the brightness of the screen in accordance with the user's preference. When a pedestal level (black level) in the video signal as a black signal is written into the blank region 37 in a conventional manner in a monitor with the function, a brightness control in the display region 36 simultaneously changes the brightness of the blank region 37, which causes a defect in which a sufficient black level cannot be displayed. To overcome this defect, the present invention firmly enables the blank region 37 to be at a black level, regardless of the user brightness function, by providing the sub-driver 2 (black signal generating circuit) which has a brightness control independently from the main-driver 1 as a source of supplying the video signals and by inputting a black signal to the display panel 3.

Figure 2A:
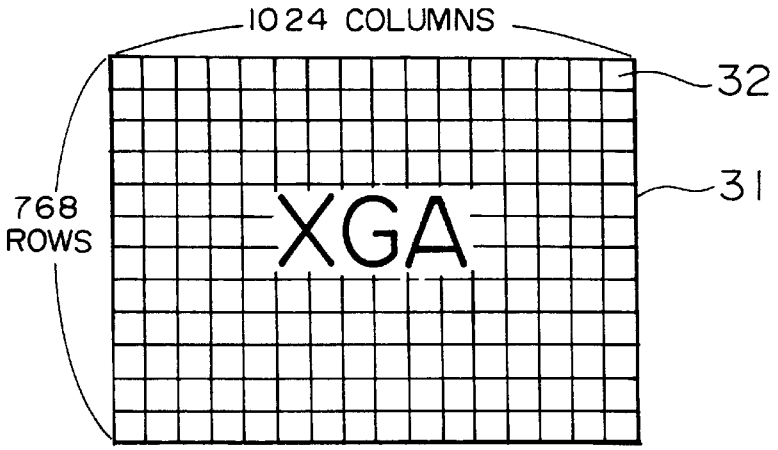
FIGS. 2A to 2C are schematic illustrations to explain the operation of the image display system shown in FIG. 1.

By referring to FIGS. 2A–2C, the operation of the image display system shown in FIG. 1 will be described in detail. As shown in FIG. 2A, in this embodiment the display panel 3 includes the screen 31 based on the XGA (extended graphics array) standard. In other words, video signals based on the XGA standard have a high resolution, and in accordance with the resolution, the screen 31 includes the pixels 32 arranged as 768 rows and 1024 columns. When the video signals VSIG based on the XGA standard are supplied from the main driver 1, all the pixels included in the screen 31 are driven for display in the display panel 3. In other words, in this case the whole screen 31 becomes a display region, and no blank region appears.

Figure 2B:
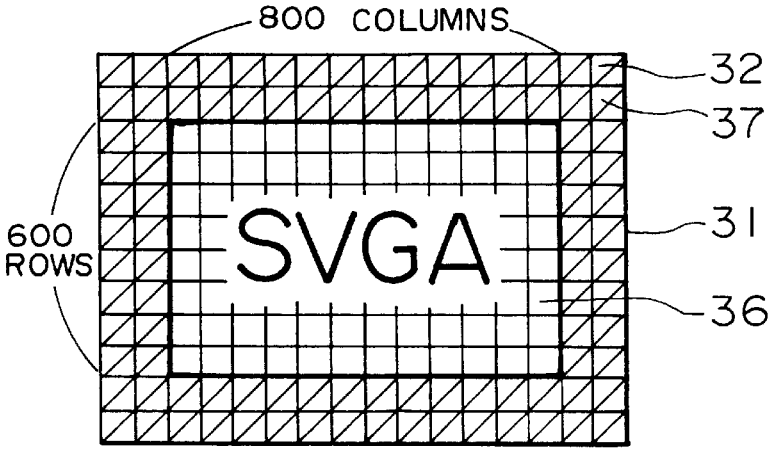

FIG. 2B shows a display condition occurring when video signals based on the SVGA (super video graphics array) standard are supplied to a display panel designed to meet the XGA standard. The SVGA standard has a lower resolution, compared with the XGA standard, and corresponds to a pixel arrangement having 600 rows and 800 columns. According to the present invention, video signals are written into the display region 36 in the screen 31 including the pixels 32 having the number of rows (600 rows) and the number of columns (800 columns) adapted for the resolution of the SVGA standard. A black signal is written into the pixels 32 belonging to the blank region 37 outside the display region 36. As described above, according to the present invention, the resolution of video signals to be displayed completely corresponds to the pixel arrangement in the display region, thus, a conventional problem such as moire cannot occur.

Figure 2C:
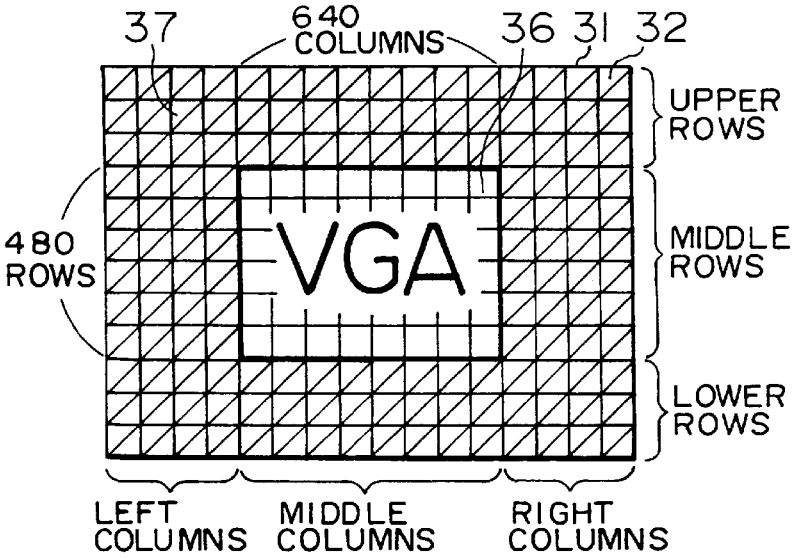

FIG. 2C shows a display condition in the display panel 3 occurring when video signals based on the VGA (video graphics array) standard having a resolution lower than that of the SVGA standard are supplied from the main-driver 1. In this case the video signals based on the VGA standard are restricted to be written into the display region 36 including the pixels 32 which correspond to 480 rows and 640 columns. A black signal is written into the blank region 37 outside the display region 36. The timing generator 4 writes the black signal at a high speed into rows of the pixels (upper rows and lower rows) included in the upper and lower portions of the blank region 37 by controlling the vertical scanning circuit 33 to operate in the display panel 3 at a high speed during, for example, a vertical blanking period for the video signal. Subsequently, the timing generator 4 sequentially writes the black signal and the video signals at a normal operating speed into each pixel in the middle rows between the upper rows and the lower rows. In this case the black signal is sequentially written into the left columns belonging to the blank region 37, subsequently the video signals are sequentially written into the middle columns included in the display region 36, and finally, the black signal is sequentially written into the right columns of the pixels. In this manner the video signals based on the VGA standard are written into only the display region 36 where the middle rows intersect with the middle columns. Instead of writing the black signal into the upper rows and the lower rows at a high speed, the black signal may be written into the upper rows and the lower rows at the same time by controlling a portion of the vertical scanning circuit 33 in the display panel 3 to operate simultaneously during a vertical blanking period for the video signal.

Figure 3:
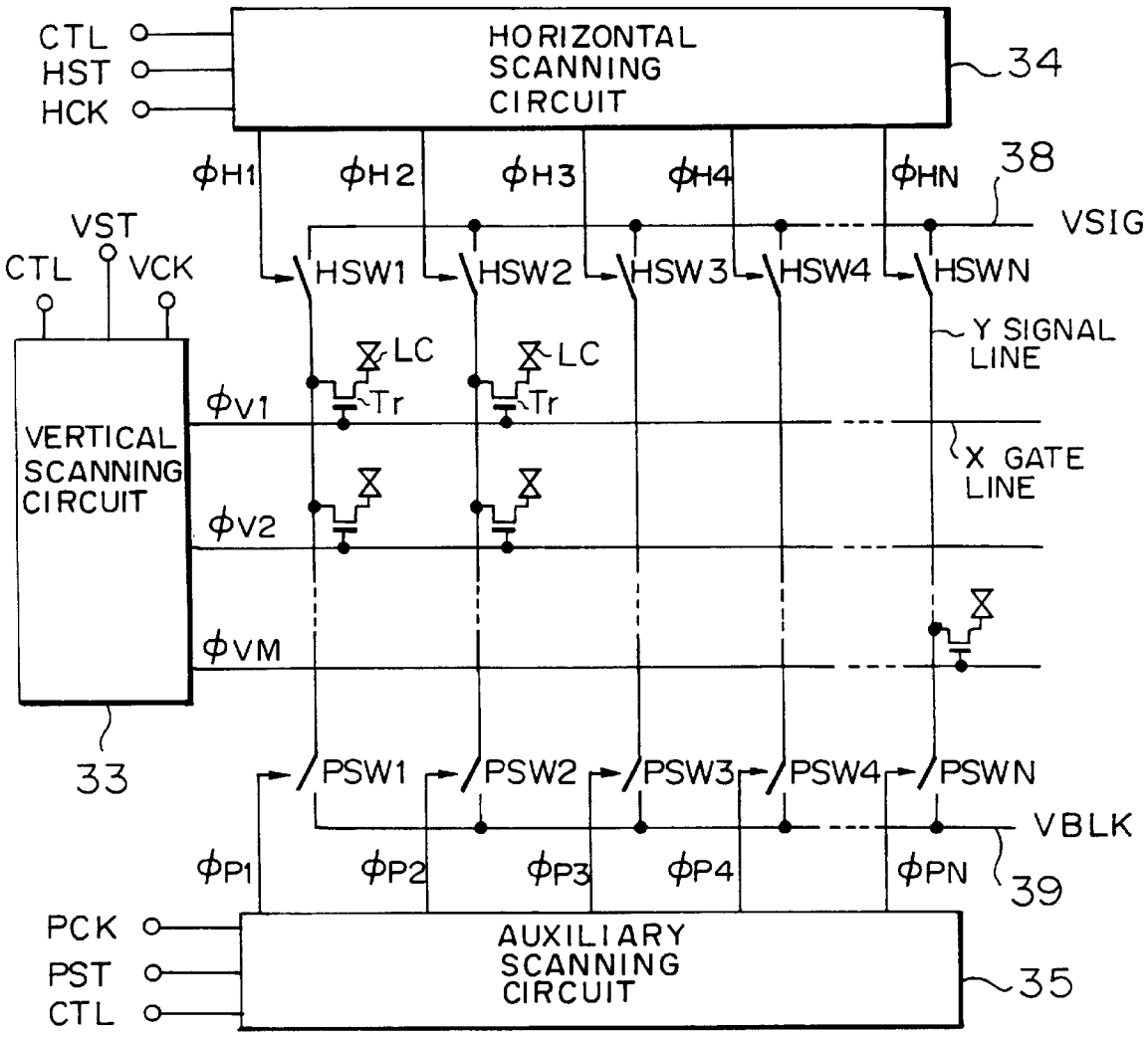
FIG. 3 is a block diagram showing a display panel included in the image display system shown in FIG. 1.

FIG. 3 shows a detailed block diagram of the display panel 3. The display panel 3 includes gate lines X arranged in rows and signal lines arranged in columns. Also, liquid crystal pixels LC are arranged in a matrix where the gate lines X and the signal lines Y intersect with each other. In this embodiment the display panel 3 includes liquid crystal pixels LC, however it need hardly be said that the pixels LC may be comprised of another electrochemical material. The liquid crystal pixels LC are driven by thin film transistors Tr. The source electrodes of the thin film transistors Tr are connected to the corresponding signal lines Y, the gate electrodes are connected to the corresponding gate lines X, and the drain electrodes are connected to the corresponding liquid crystal pixels LC.

The respective gate lines X are connected to the vertical scanning circuit 33. The vertical scanning circuit 33 includes, for example, a shift register in which D-type flip-flops (DFF) are connected in multi-stages. The vertical scanning circuit 33 sequentially transfers the vertical start signal VST in accordance with the vertical clock signal VCK, and supplies selection pulses $\phi_{V1}$ to $\phi_{VM}$ to the gate lines X, thereby sequentially scanning the gate lines X and selecting the liquid crystal pixels LC for one row during each line period.

In addition, the respective signal lines Y are connected to an input line 38 via horizontal switching devices HSW corresponding to the signal lines Y. The input line 38 is supplied with the video signals VSIG from the main-driver 1. The input line 38 is also provided with the horizontal scanning circuit 34 for switching each switching device HSW. In other words, the horizontal scanning circuit 34 sequentially transfers the horizontal start signal HST in synchronism with the horizontal clock signal HCK, and outputs sampling pulses $\phi_{H1}$, $\phi_{H2}$, $\phi_{H3}$ to $\phi_{HN}$ to switch the horizontal switching devices HSW. The video signals VSIG are sampled with respect to each signal line Y by the above-described operation, and are written into the pixels LC for one row selected within one line period via the thin film transistors Tr which are conductive.

A feature of the present invention is that the respective signal lines Y are connected to another input line 39 via other horizontal switching devices PSW. This input line 39 is supplied with the black signal VBLK from the sub-driver 2. The input line 39 is provided in conjunction with the auxiliary scanning circuit 35 for switching the horizontal switching devices PSW. In other words, the auxiliary scanning circuit 35 sequentially transfers the start signal PST in synchronism with the clock signal PCK, and outputs sampling pulses $\phi_{P1}$, $\phi_{P2}$, $\phi_{P3}$ to $\phi_{PN}$ to switch the horizontal switching devices PSW. Thereby, the black signal VBLK is sampled with respect with each signal line Y, and is written into the pixels LC for one row selected within one line period via the thin film transistors Tr which are conductive.

The operation of the display panel 3 will be described. As shown in FIG. 2A, when video signals based on the XGA standard are inputted, only the video signals VSIG are written into all the liquid crystal pixels LC included in the screen 31. Accordingly, the vertical scanning circuit 33 sequentially outputs selection pulses $\phi_V$ from the first stage to the end stage. Also, the horizontal scanning circuit 34 performs a normal transfer operation in accordance with the control signal CTL, and sequentially outputs sampling pulses $\phi_H$ from the first stage to the end stage. In this manner the video signals VSIG based on the XGA standard are appropriately written into all the liquid crystal pixels LC. In this case the auxiliary scanning circuit 35 completely aborts the transfer operation in accordance with the control signal CTL, which maintains all the horizontal switching devices PSW in the off state.

In addition, as shown in FIG. 2C, when the video signals VSIG based on the VGA standard are written, the black signal is first written at a high speed within the vertical blanking period with respect to the upper rows and the lower rows belonging to the blank region 37. Accordingly, the vertical scanning circuit 33 transfers the vertical start signal VST at a high speed with respect to the gate lines X corresponding to the upper rows and the lower rows in accordance with the accelerated vertical clock signal VCK, and sequentially outputs the selection pulses $\phi_V$. Then, the vertical scanning circuit 33 skips the transfer operation for the stages corresponding to the middle rows. Also, the auxiliary scanning circuit 35 is activated in accordance with the control signal CTL, and sequentially outputs the selection pulses $\phi_P$ to switch on the horizontal switching devices PSW, thereby writing the black signal VBLK. The auxiliary scanning circuit 35 may simultaneously switch on the horizontal switching devices PSW instead of sequentially switching on the horizontal switching devices PSW. To the contrary, the horizontal scanning circuit 34 is controlled in accordance with the control signal CTL to not operate. Subsequently, after a lapse of the vertical blanking period, the black signal VBLK and the video signals VSIG are separately written into the middle rows as shown in FIG. 2C. In this case the vertical scanning circuit 33 outputs the selection pulses $\phi_V$ at a normal operating speed with respect to only the gate lines X corresponding to the middle rows in accordance with the control signal CTL. Also, the auxiliary scanning circuit 35 selectively switches on only the horizontal switching devices corresponding to the left columns or the right columns, while the horizontal scanning circuit 34 sequentially switches on only the horizontal switching devices HSW corresponding to the middle columns as shown in FIG. 2C.

Figure 4:
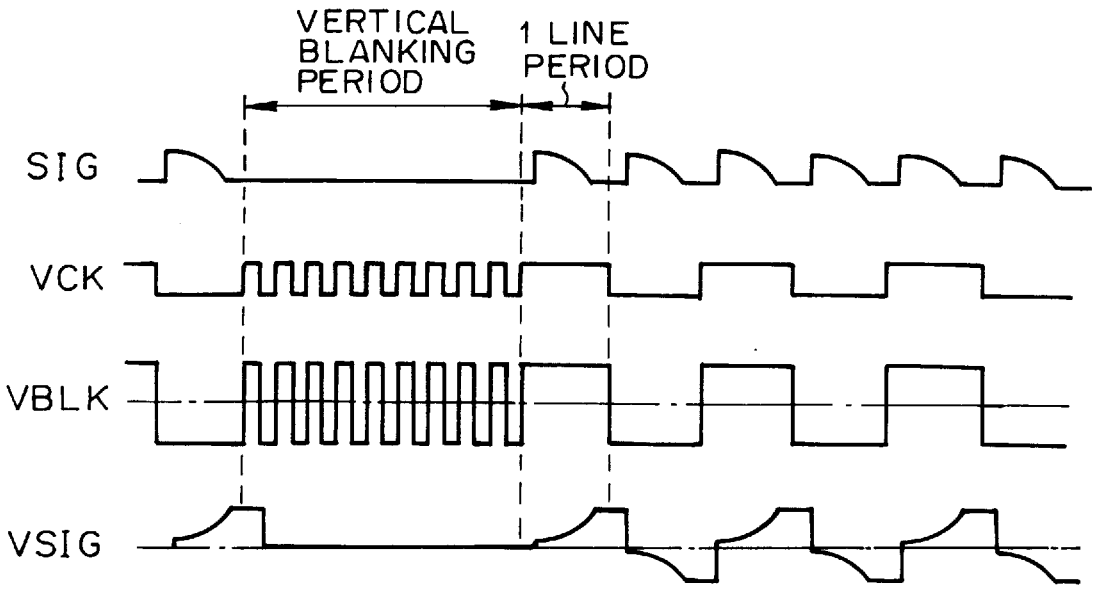
FIG. 4 is a waveform chart to explain the operation of the display panel shown in FIG. 3.

By referring to FIG. 4, the high speed operation of writing the black signal with respect to the upper rows and the lower rows included in the blank region will be described. As shown in the timing chart in FIG. 4, the original video signal SIG includes video data for each line period after the vertical blanking period. The vertical clock signal VCK supplied from the timing generator 4 is accelerated only within the vertical blanking period. After that, the vertical clock signal VCK is inverted for each line period, and a normal operation starts. The black signal VBLK is converted to an AC signal as described above. At this time, in the vertical blanking period the black signal VBLK is alternatively inverted at a high speed in response to the accelerated vertical clock signal VCK. The video signals VSIG supplied from the main-driver 1 to the display panel 3 are converted to AC signals in which the polarity is inverted for each line period. In the vertical blanking period no video data is included, and this characteristic is used to write the black signal VBLK at a high speed. In such a manner, in this embodiment the transfer speed by the vertical scanning circuit 33 is accelerated within the vertical blanking period, and the black signal VBLK is written into the pixels for each row (line). According to this driving method, the black signal VBLK is simultaneously written into only the pixels for one line, which results in an advantage in which the load is relatively low. In addition, even in the blank region 37 displaying black, driving-by-inversion-to-line is realized.

Figure 5:
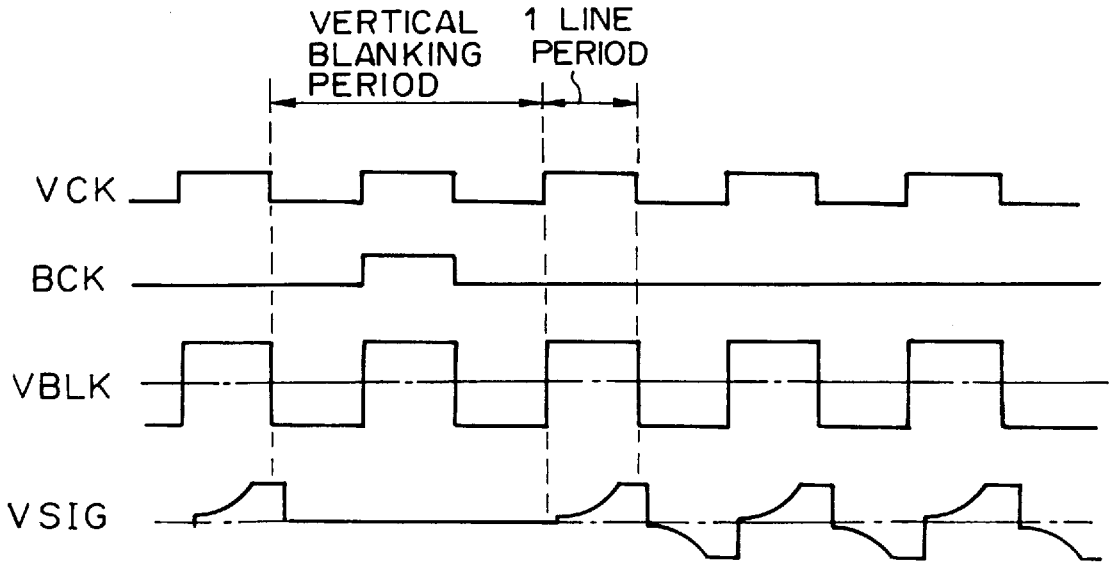
FIG. 5 is a waveform chart to explain the operation of the display panel shown in FIG. 3.

FIG. 5 shows another method of writing the black signal. In this embodiment a portion of the vertical scanning circuit 33 in the display panel 3 is simultaneously driven during the vertical blanking period so that the black signal is simultaneously written into the upper rows and the lower rows of the blank region 37. In other words, the timing generator 4 supplies a single clock signal BCK during the vertical blanking period. The vertical scanning circuit 33 in the display panel 3 simultaneously outputs the selection pulses $\phi_V$ with respect to the gate lines X corresponding to the upper rows and the lower rows in accordance with the clock signal BCK. Thereby, the black signal VBLK is simultaneously written into all the upper rows and all the lower rows. After a lapse of the vertical blanking period, the display panel 3 starts a normal operation, in which the video signals VSIG and the black signal VBLK are written into the pixels 32 for one row in each column during each line period. In this manner, in this embodiment, the upper rows and the lower rows of the blank region 37 are simultaneously selected during a specified time (output time for the clock signal BCK) in the vertical blanking period, and the black signal is simultaneously written into the pixels 32. Since this method for driving does not require high speed transfer, compared with the case shown in FIG. 4, the period for writing into the pixel potential can be sufficiently prepared, however, the black signal cannot be written with respect to the blank region 37 with the inversion-to-line method. Consequently, according to this method for driving, the black signal is written with respect to the upper rows and the lower rows of the blank region 37 with the inversion-to-field method.

Figure 6:
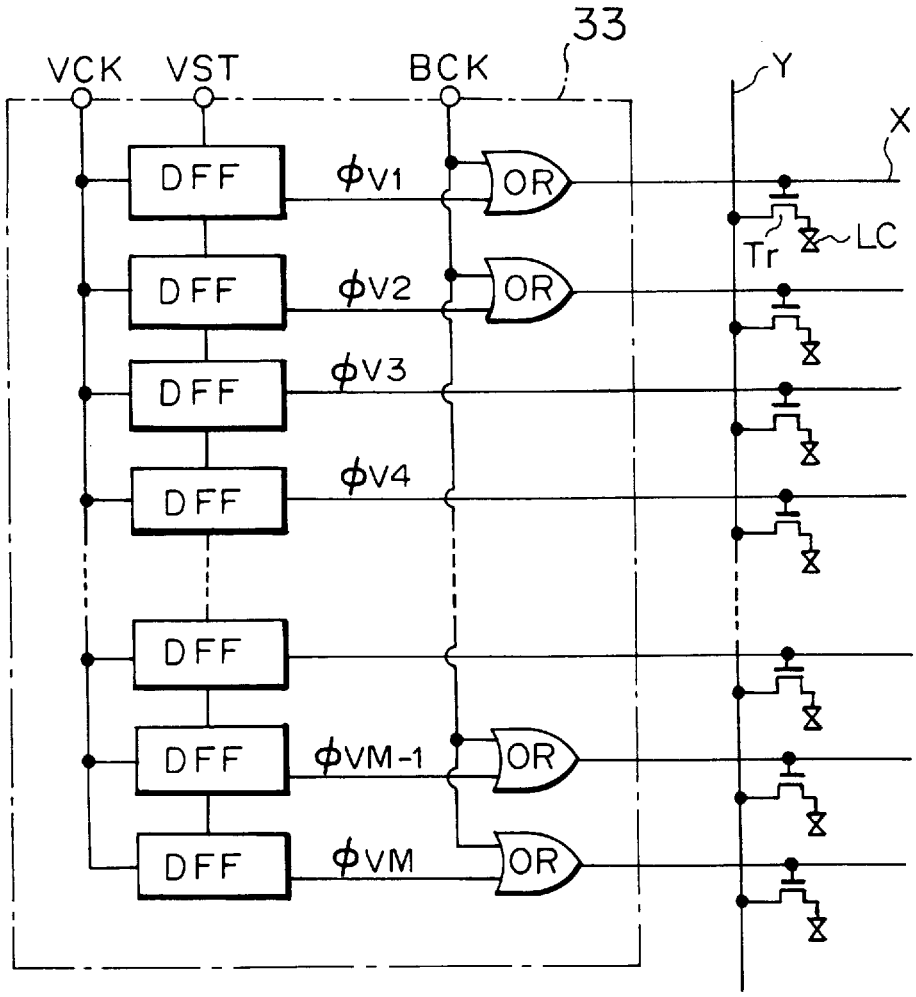
FIG. 6 is a circuit diagram showing an example of a vertical scanning circuit built in the display panel.
Figure 7:
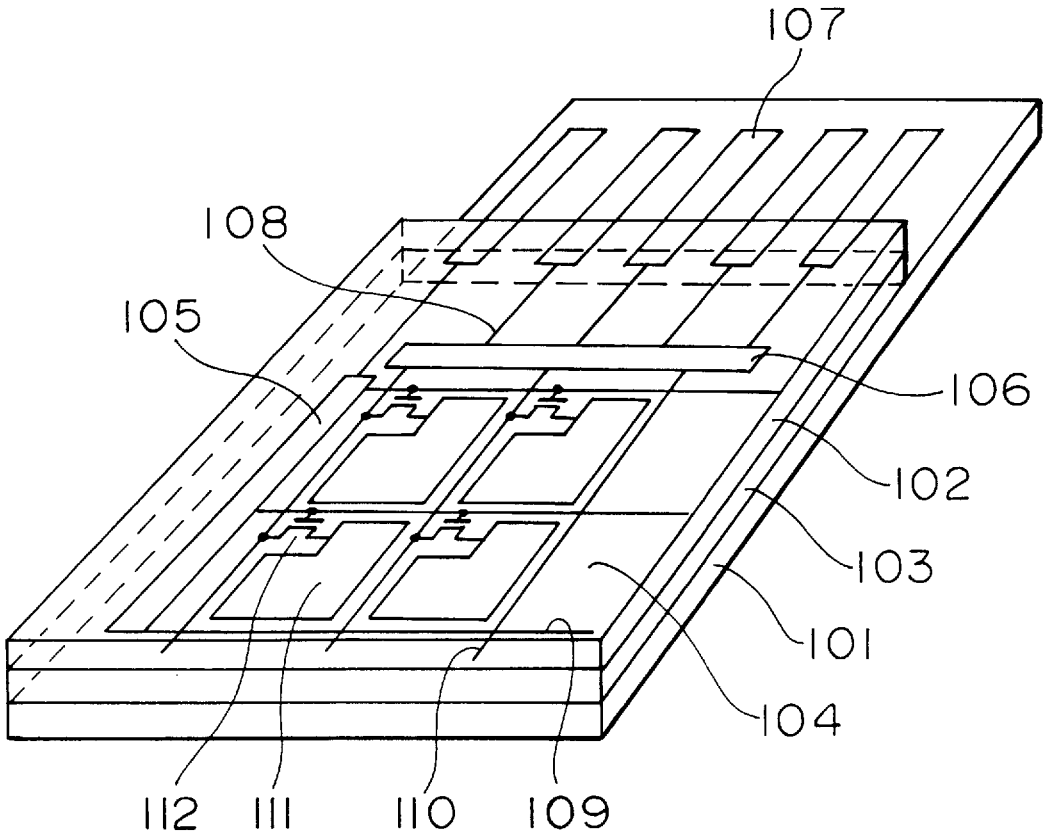
FIG. 7 (PRIOR ART)
FIG. 7 is a schematic perspective view illustrating one example of a conventional display panel.

FIG. 6 shows a detailed example of the vertical scanning circuit 33 used for the driving method shown in FIG. 5. The vertical scanning circuit 33 includes a shift register formed by connecting D-type flip-flops DFF in multi-stages. The vertical scanning circuit 33 sequentially transfers the vertical start signal VST in accordance with the vertical clock signal VCK, and sequentially outputs the selection pulses $\phi_V$ with respect to the corresponding gate lines X. The outputs of the D-type flip-flops DFF in the stages corresponding to the upper rows and the lower rows of the blank region 37 are connected to OR gate devices OR. When the black signal is simultaneously written into the upper rows and the lower rows of the blank region 37, the clock signal BCK is directly outputted to the gate lines X via the OR gates.

What is claimed is:

1. An image display system comprising:

a driver for supplying a plurality of different types of video signals having different respective standards of resolution;

a black signal generating circuit for supplying a black signal independent from said plurality of different types of video signals and for controlling a brightness of said black signal independently from a brightness control of said plurality of different types of video signals;

a display panel having a screen including a plurality of pixels arranged in a matrix, a vertical scanning circuit for sequentially selecting rows of said pixels, and a horizontal scanning circuit for sequentially distributing said video signals and said black signal to columns of said pixels so as to be written into selected ones of said pixels, wherein said horizontal scanning circuit comprises a first scanning circuit for sequentially distributing said plurality of different types of video signals to said columns of said pixels so as to be written into the selected ones of said pixels, and a second scanning circuit for distributing said black signal so as to be written into pixels forming a blank region; and a timing generator for controlling a timing of distribution of a control signal in accordance with the respective standard of resolution of said plurality of different types of video signals supplied from said driver to said vertical scanning circuit and said horizontal scanning circuit in said display panel, said timing generator writing said plurality of different types of video signals in a display region within said screen including said rows and columns of said pixels adapted for a respective standard of resolution, and said timing generator including means for controlling said black signal to be written into said pixels forming said blank region of said screen outside said display region.

2. The image display system according to claim 1, wherein said timing generator controls said vertical scanning circuit in said display panel to operate so that said black signal is written into each row of said pixels included in upper and lower portions of said blank region at a speed higher than a normal operating speed during a vertical blanking period present in each of said plurality of different types of video signals.

3. The image display system according to claim 2, wherein said timing generator includes means for writing said black signal in said blank region by an inversion-to-line method.

4. The image display system according to claim 1, wherein said timing generator controls said vertical scanning circuit in said display panel so that said black signal is written into rows of said pixels included in upper and lower portions of said blank region at a normal operating speed during a vertical blanking period present in each of said plurality of different types of video signals.

5. The image display system according to claim 4, wherein said timing generator includes means for writing said black signal by an inversion-to-field method with respect to upper rows and lower rows in said blank region.

6. A method for driving an image display system including:

a driver for supplying a plurality of different types of video signals having different respective standards of resolution;

a black signal generating circuit for supplying a black signal in dependent from said plurality of different types of video signals;

a display panel having a screen comprised of a plurality of pixels arranged in a matrix, a vertical scanning circuit for sequentially selecting rows of said plurality of pixels, and a horizontal scanning circuit for sequentially distributing said video signals and said black signal to columns of said pixels so as to be written into selected ones of said pixels, wherein said horizontal scanning circuit comprises a first scanning circuit for sequentially distributing said plurality of different types of video signals to said columns of said pixels so as to be written into the selected ones of said pixels, and a second scanning circuit for distributing said black signal so as to be written into pixels forming a blank region;

and a timing generator for controlling a timing of distribution of a control signal in accordance with the respective standard of resolution of said plurality of different types of video signals supplied from said driver to each scanning circuit in said display panel, said method comprising the steps of:

writing using said first scanning circuit said plurality of different types of video signals into said display region within said screen including said rows and columns of said pixels adapted for the respective standard of resolution;

controlling a brightness of said black signal independently from a brightness control of said plurality of different types of video signals; and writing using said second scanning circuit said black signal into selected ones of said pixels belonging to said blank region of said screen outside said display region.

7. The method for driving an image display system according to claim 6, wherein said black signal is written into each row of said pixels included in upper and lower portions of said blank region at a normal operating speed during a vertical blanking period present in said video signals.

8. The method for driving an image display system according to claim 6, wherein said black signal is written into rows of said pixels included in upper and lower portions of said blank region at a speed higher than a normal operating speed during a vertical blanking period present in said video signals.

* * * * *